US006231426B1

(12) United States Patent
Liao

(10) Patent No.: US 6,231,426 B1
(45) Date of Patent: May 15, 2001

(54) MAGNETIC POLISHING MACHINE

(76) Inventor: Lu-Jung Liao, No. 19-23, Kuang Min Road, Si Tun Area, Taichung (TW)

( * ) Notice: Subject to any disclaimer, the term of this patent is extended or adjusted under 35 U.S.C. 154(b) by 0 days.

(21) Appl. No.: 09/595,020

(22) Filed: Jun. 16, 2000

(51) Int. Cl.[7] ..... B24B 1/00
(52) U.S. Cl. ..... 451/32; 451/326; 451/327
(58) Field of Search ..... 451/32, 326, 327, 451/328, 329, 74, 113, 114

(56) References Cited

U.S. PATENT DOCUMENTS 5,044,128 9/1991 Nakanko .
5,662,516 * 9/1997 You ..... 451/32
6,146,243 * 11/2000 Imahashi ..... 451/32

* cited by examiner

*Primary Examiner*—Derris H. Banks
(74) *Attorney, Agent, or Firm*—Browdy and Neimark

(57) ABSTRACT

A magnetic polishing machine comprises a polishing tub and an alternating magnetic field generator for producing a magnetic field effect to induce a number of magnetic media to travel at a high speed to polish by rubbing a workpiece contained in the polishing tub. The magnetic polishing machine further comprises a built-in separation tub and a homomagnetic field generator for generating a unidirectional magnetic field effect to separate the cohered magnetic media from the workpiece which is transferred from the polishing tub to the separation tub upon completion of the polishing process.

9 Claims, 3 Drawing Sheets

MAGNETIC POLISHING MACHINE

FIELD OF THE INVENTION

The present invention relates generally to a polishing machine, and more particularly to a magnetic polishing machine.

BACKGROUND OF THE INVENTION

The U.S. Pat. Nos. 5,662,516 and 5,044,128 disclose a polishing machine comprising a polishing tub in which a plurality of magnetic media are activated by a magnetic field effect to bring about the rubbing of work pieces so as to make them bright and lustrous.

Such prior art polishing machines as described above are defective in design in that the magnetic media are apt to be attracted to the surface of a workpiece. The removal of the magnetic media from the surface of a polished work piece is a costly operation, which is often done by an expensive peripheral equipment. It is conceivable that an extra floor space must be allocated for disposition of the peripheral equipment.

SUMMARY OF THE INVENTION

The primary objective of the present invention is to provide a magnetic polishing machine which is free from the drawbacks of the prior art polishing machines described above.

In keeping with the principle of the present invention, the foregoing objective of the present invention is achieved by the magnetic polishing machine comprising a housing in which a polishing tub, a separation tub, an alternating magnetic field generator, and a homomagnetic field generator are disposed such that the polishing tub is corresponding in location to the alternating magnetic field generator, and that the separation tub is corresponding in location to the homomagnetic field generator. The polishing tub contains a plurality of magnetic polishing media, which are induced by the homomagnetic field effect to move in one direction to polish the surface of a workpiece by rubbing. The process of removing the cohered magnetic media from the surface of the workpiece is carried out in the separation tub.

DETAILED DESCRIPTION OF THE INVENTION

Figure 1:
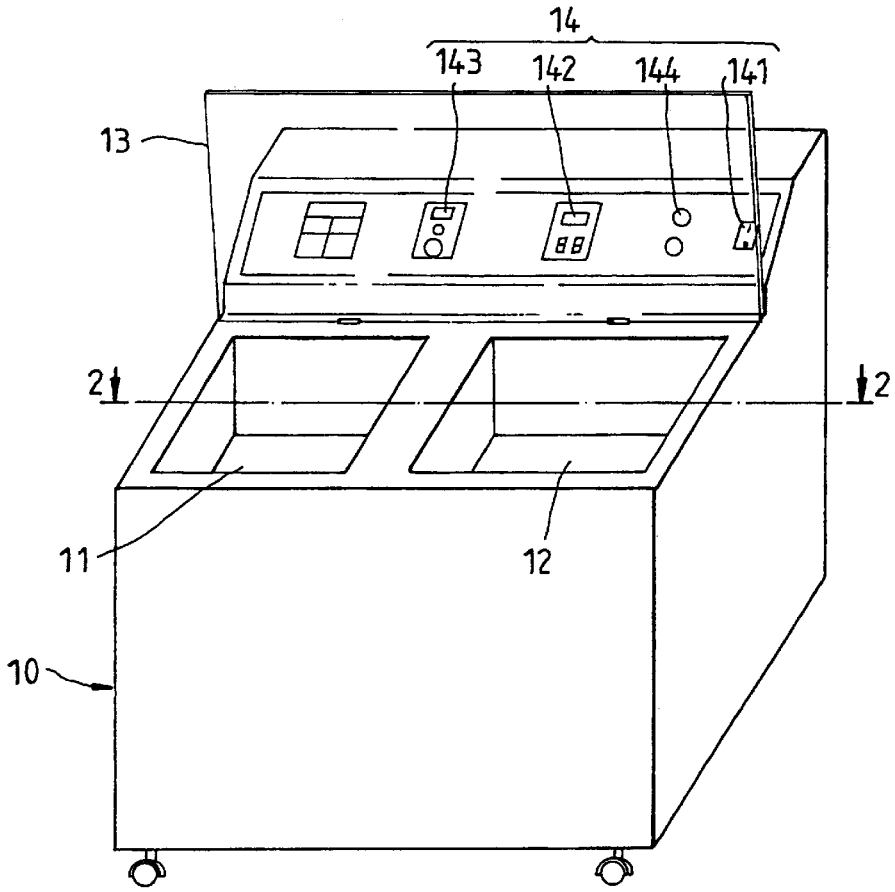
FIG. 1 shows a perspective view of a magnetic polishing machine of a preferred embodiment of the present invention.
Figure 2:
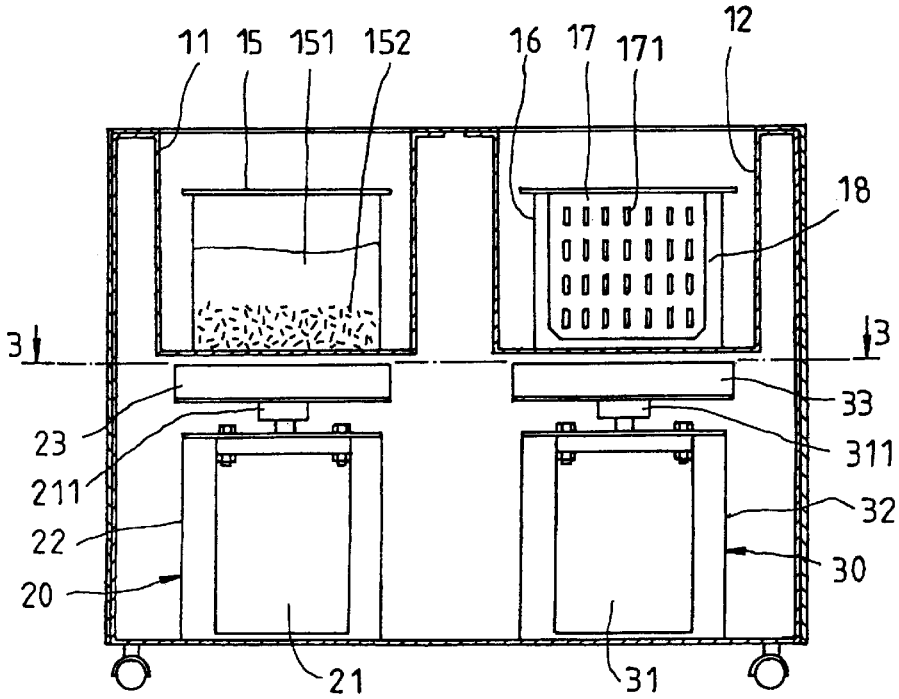
FIG. 2 shows a sectional view of a portion taken along the direction indicated by a line 2—2 as shown in FIG. 1.
Figure 3:
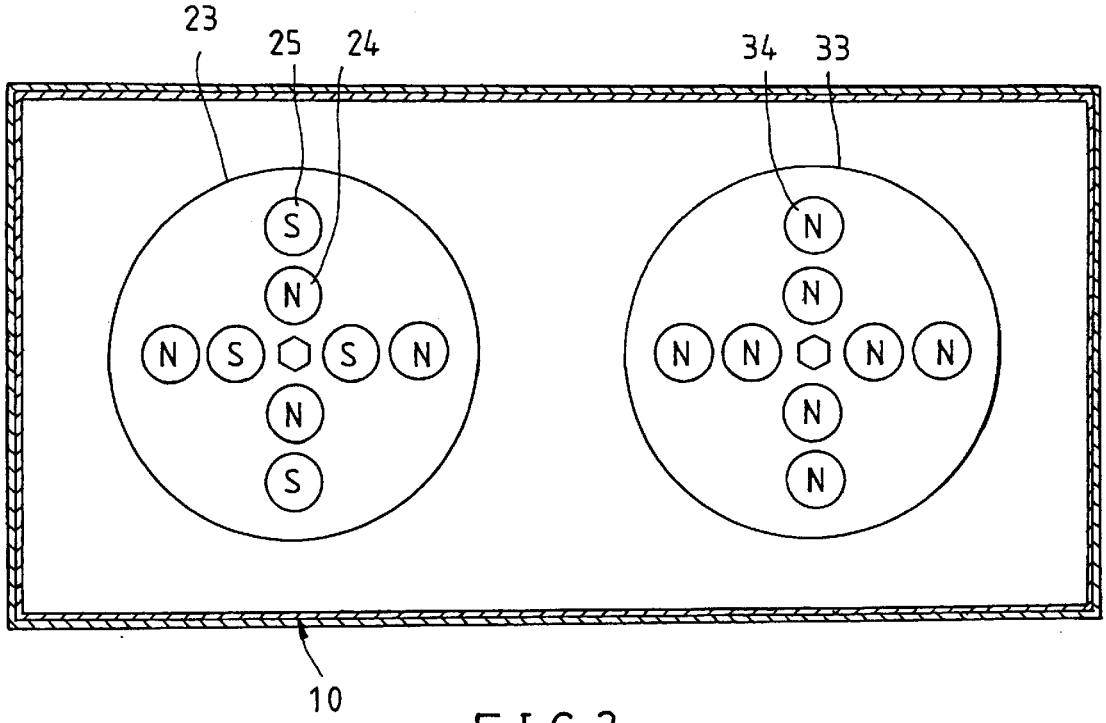
FIG. 3 shows a sectional view of a portion taken along the direction indicated by a line 3—3 as shown in FIG. 2.

As shown in FIGS. 1–3, a magnetic polishing machine 100 embodied in the present invention comprises a housing 10, an alternating magnetic field generator 20, and a homomagnetic field generator 30.

The housing 10 contains a polishing tub 11 and a separation tub 12. The housing 10 is provided with a hinged soundproof lid 13 for covering the polishing tub 11 and the separation tub 12. The housing 10 is further provided with a control panel 14 having a power switch 141, a timer switch 142, a speed adjustment switch 143, and a forward-reverse switch 144, which are all electrically connected with the alternating magnetic field generator 20 and the homomagnetic field generator 30.

The polishing tub 11 is provided with a container 15 having an open top. The container 15 contains a polishing fluid 151 and a plurality of needle-shaped metal magnetic polishing media 152.

The separation tub 12 is provided with a cylindrical container 16 in which a screen container 17 is disposed such that there is a gap 18 between the cylindrical container 16 and the screen container 17. The screen container 17 is provided in the side wall and the bottom thereof with a number of meshes 171 which are dimensioned to allow the passage of the magnetic polishing media 152.

The alternating magnetic field generator 20 is disposed in the interior of the housing 10 and is formed of a motor 21, a fixation seat 22, and a rotary disk 23. The motor 21 is mounted under the polishing tub 11 by the fixation seat 22. The motor 21 has an output shaft 211 which is fastened with the rotary disk 23 located under the polishing tub 11. The rotary disk 23 is provided in the top thereof with a plurality of permanent heteropolar magnets 24 and 25, with each having the magnetic N and S poles. The permanent magnets 24 and 25 are circularly arranged at an interval of 90 degrees.

The homomagnetic field generator 30 is disposed in the interior of the housing 10 and is formed of a motor 31, a fixation seat 32, and a rotary disk 33. The motor 31 is mounted under the separation tub 12 by the fixation seat 32. The motor 31 has an output shaft 311 which is fastened with the rotary disk 33 located under the separation tub 12. The rotary disk 33 is provided in the top thereof with a plurality of permanent homopolar magnets 34.

Figure 4:
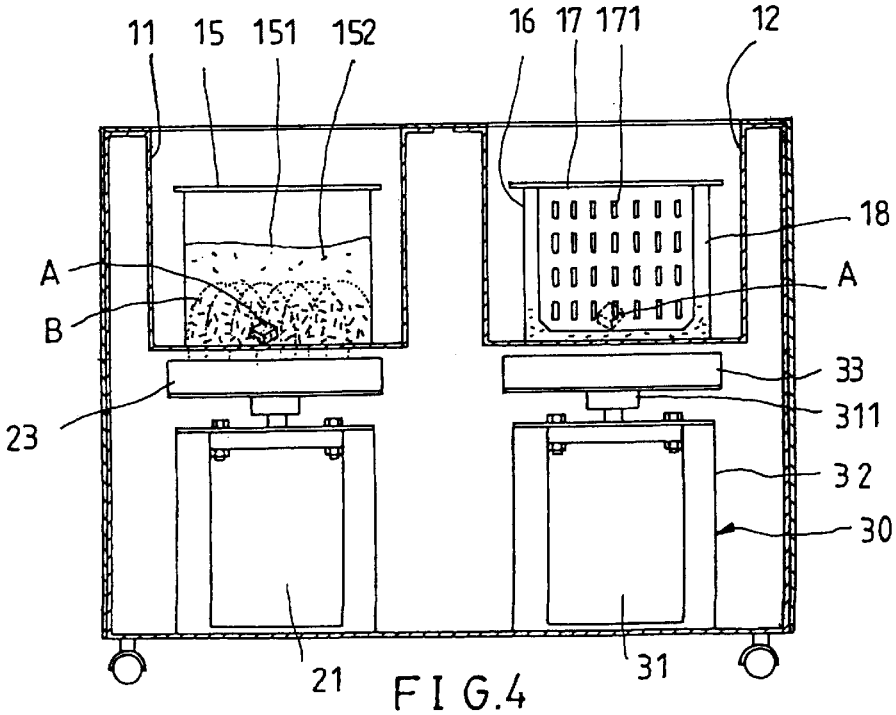
FIG. 4 shows a sectional schematic view of the preferred embodiment of the present invention at work.

As shown in FIG. 4, a workpiece A is placed in the container 15 of the polishing tub 11 before the motor 21 is started to actuate the rotary disk 23 to turn. In light of the N poles and the S poles of the magnets 24 and 25 being different in location, an alternating magnetic field is brought about as the rotary disk 23 is rotated, thereby resulting in the induction of the magnetic polishing media 152 by the magnetic force B. The magnetic polishing media 152 are thus caused to travel at a high speed to smooth and brighten the surface of the workpiece A by rubbing. The polishing fluid 151 serves to bring about the cooling effect and the cleansing effect.

Upon completion of the polishing process, the workpiece A, the magnetic polishing media 152, and the polishing fluid 151 are poured together into the screen container 17 of the separation tub 12. The workpiece A and the magnetic polishing media 152 are kept in the screen container 17, whereas the polishing fluid 151 is kept in the cylindrical container 16. As the motor 31 is started, the rotary disk 33 is driven by the motor 31 to rotate. As a result, the homopolar magnets 34 bring about a unidirectional magnetic field effect to separate the cohered magnetic media 152 from the polished workpiece A. The separated magnetic media 152 are collected in the cylindrical container 16 via the meshes 171.

Figure 5:
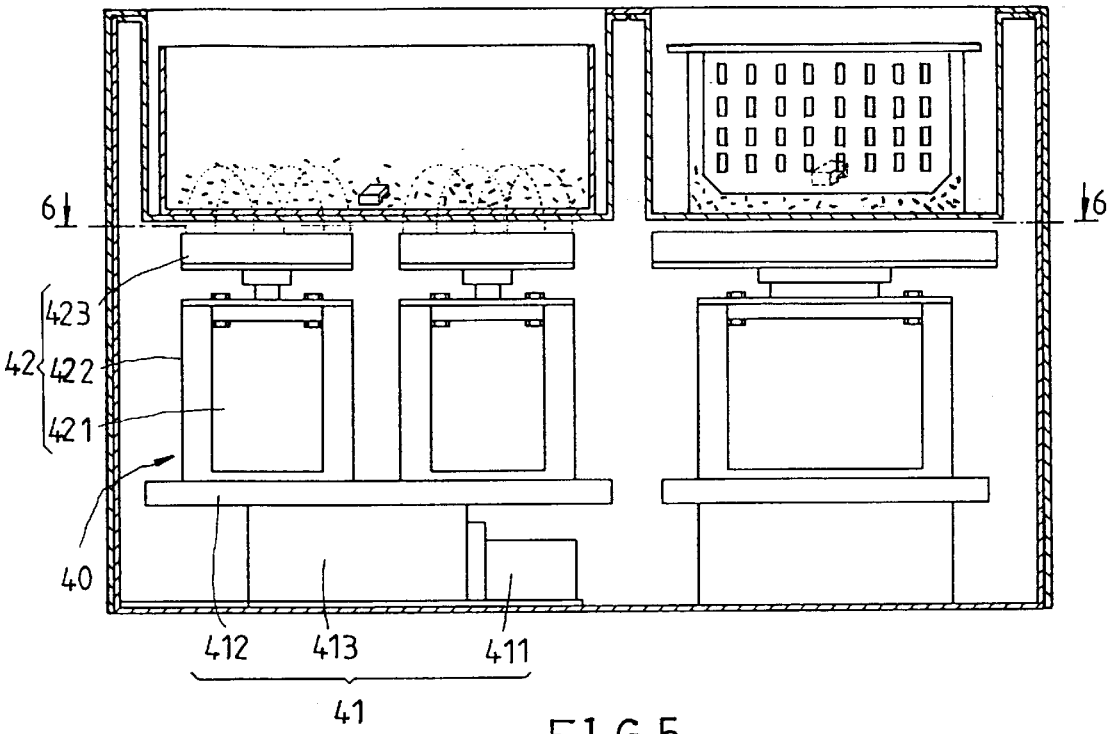
FIG. 5 shows a sectional schematic view of another preferred embodiment of the present invention.
Figure 6:
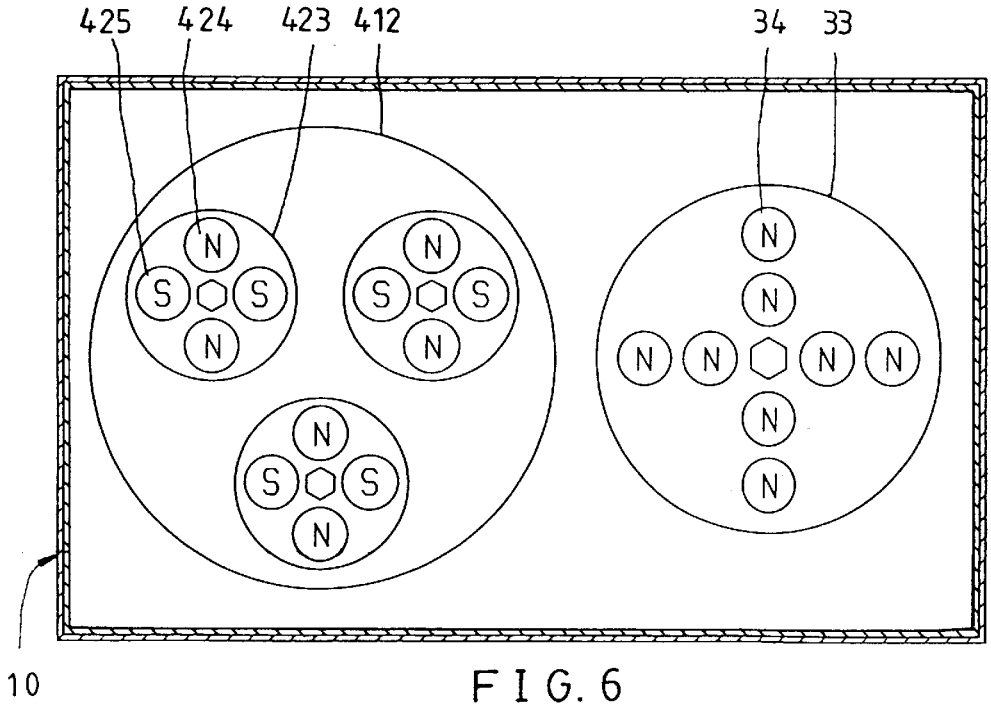
FIG. 6 shows a sectional view of a portion taken along the direction indicated by a line 6—6 as shown in FIG. 5.

As shown in FIGS. 5 and 6, an alternating magnetic field generator 40 of the second preferred embodiment of the present invention comprises a rotating member 41 and three magnetic field generating units 42.

The rotating member 41 has an action motor 411 mounted in the bottom of the housing, a rotary seat 412, and an index head 413 connecting the motor 411 and the rotary seat 412. The action motor 411 drives via the index head 413 the rotary seat 412 to turn back and forth in a predetermined range, such as a range of 90 degrees.

Each of the magnetic field generating units 42 is formed of a motor 421, a fixation seat 422, and a rotary disk 423. The units 42 are equidistantly arranged on the rotary seat 412 such that the motor 412 is mounted on the top of the rotary seat 412 by the fixation seat 422 for driving the rotary disk 423 corresponding to the polishing tub 11. The rotary disk 423 is provided with a plurality of magnets 424 and 425, with the magnets 424 having the N pole, and with the magnets 425 having the S pole.

As the rotary seat 412 turns, the rotary disks 423 of the units 42 turn at the same time such that each unit brings about an induction magnetic field. As a result, any space in the container 15 is provided with a time-lapse polar alternating magnetic field capable of inducing the magnetic polishing media 152 to travel in all directions and at all angles to polish the surface of the workpiece A with a greater efficiency.

What is claimed is:

1. A magnetic polishing machine comprising:

a housing;

a polishing tub disposed in said housing and provided with a plurality of magnetic polishing media;

an alternating magnetic field generator disposed in said housing such that said alternating magnetic field generator is corresponding in location to said polishing tub whereby said alternating magnetic field generator brings about a magnetic field effect to induce said magnetic polishing media to travel in a direction to polish by rubbing a workpiece contained in said polishing tub;

a separation tub disposed in said housing; and a homomagnetic field generator disposed in said housing such that said homomagnetic field generator is corresponding in location to said separation tub whereby said homomagnetic field generator brings about a unidirectional magnetic field effect to separate the cohered magnetic polishing media from the workpiece which is transferred from said polishing tub to said separation tub.

2. The magnetic polishing machine as defined in claim 1, wherein said alternating magnetic field generator is formed of a motor, and a rotary disk fastened with an output shaft of said motor such that said rotary disk is corresponding in location to said polishing tub whereby said rotary disk is provided with a plurality of heteropolar magnets.

3. The magnetic polishing machine as defined in claim 1, wherein said homomagnetic field generator comprises a motor, and a rotary disk fastened with an output shaft of said motor such that said homomagnetic field generator is corresponding in location to said separation tub whereby said rotary disk is provided with a plurality of homopolar magnets.

4. The magnetic polishing machine as defined in claim 1, wherein said alternating magnetic field generator comprises:

a rotating member disposed in said housing and formed of an action motor and a rotary seat driven by said action motor; and at least two magnetic field generating units, with each comprising a motor mounted on said rotary seat such that an output shaft of said motor is fastened with a rotary disk corresponding in location to said polishing tub whereby said rotary disk is provided with a plurality of heteropolar magnets.

5. The magnetic polishing machine as defined in claim 4, wherein said rotating member is further formed of an index head whereby said index head is connected with said rotary seat to enable said rotary seat to turn in a reciprocating manner within a predetermined range.

6. The magnetic polishing machine as defined in claim 1, wherein said polishing tub is provided with a container fitted thereinto; wherein said magnetic polishing media are disposed in said container.

7. The magnetic polishing machine as defined in claim 6, wherein said container contains a polishing fluid.

8. The magnetic polishing machine as defined in claim 1, wherein said separation tub is provided with a cylindrical container fitted thereinto whereby said cylindrical container is provided with a screen container fitted thereinto such that said screen container is not in contact with said cylindrical container.

9. The magnetic polishing machine as defined in claim 1, wherein said housing is provided with a control panel having a power switch, a timer switch, a speed adjustment switch, and a rotational direction switch, which are electrically connected with said alternating magnetic field generator and said homomagnetic field generator.

* * * * *